US009948008B2

(12) United States Patent
Chou et al.

(10) Patent No.: US 9,948,008 B2
(45) Date of Patent: Apr. 17, 2018

(54) METHOD FOR ACHIEVING MULTIPLE BEAM RADIATION VERTICAL ORTHOGONAL FIELD COVERAGE BY MEANS OF MULTIPLE FEED-IN DISH ANTENNA

(71) Applicant: NATIONAL CHUNG SHAN INSTITUTE OF SCIENCE AND TECHNOLOGY ELECTRONIC SYSTEMS RESEARCH DIVISION, Taoyuan (JP)

(72) Inventors: Hsi-Tseng Chou, Taipei (TW); Shang-Che Chang, Taoyuan (TW)

(73) Assignee: NATIONAL CHUNG SHAN INSTITUTE OF SCIENCE AND TECHNOLOGY ELECTRONIC SYSTEMS RESEARCH DIVISION, Taoyuan (TW)

( * ) Notice: Subject to any disclaimer, the term of this patent is extended or adjusted under 35 U.S.C. 154(b) by 240 days.

(21) Appl. No.: 15/047,915

(22) Filed: Feb. 19, 2016

(65) Prior Publication Data

US 2017/0244170 A1 Aug. 24, 2017

(51) Int. Cl.

| | |
|---|---|
| ***H01Q 13/02*** | (2006.01) |
| ***H01Q 15/16*** | (2006.01) |
| ***H01Q 19/08*** | (2006.01) |
| ***H01Q 19/17*** | (2006.01) |
| ***H01Q 25/00*** | (2006.01) |

(52) U.S. Cl.

CPC ..... *H01Q 13/0258* (2013.01); *H01Q 13/02* (2013.01); *H01Q 15/16* (2013.01); *H01Q 19/08* (2013.01); *H01Q 19/17* (2013.01); *H01Q 25/007* (2013.01)

(58) Field of Classification Search

CPC ..... H01Q 3/005; H01Q 1/246; H01Q 21/00; H04B 17/16; H04B 17/17

See application file for complete search history.

(56) References Cited

U.S. PATENT DOCUMENTS

2008/0062056 A1* 3/2008 Hoferer ..... H01P 1/161 343/776

2011/0012801 A1* 1/2011 Monte ..... H01Q 1/288 343/762

* cited by examiner

*Primary Examiner* — Dameon E Levi
*Assistant Examiner* — David Lotter
(74) *Attorney, Agent, or Firm* — Chun-Ming Shih

(57) ABSTRACT

A method for achieving multiple beam radiation vertical orthogonal field coverage by means of multiple feed-in dish antenna, comprising using a total metallic disc and plural feed-in antenna components, wherein it is possible to generate multiple sets of radiation beams by applying multiple sets of feed-in antenna components, and the coverage ranges created by different radiation beams may uniformly distribute there between so as to generate multiple communication service coverage areas. Moreover, since the field formed by the reflection of the total metallic disc is characterized in vertical orthogonality, advantages such as effectively increased coverage, improved energy utilization and radiation beam switches or the like can be provided.

12 Claims, 10 Drawing Sheets

METHOD FOR ACHIEVING MULTIPLE BEAM RADIATION VERTICAL ORTHOGONAL FIELD COVERAGE BY MEANS OF MULTIPLE FEED-IN DISH ANTENNA

BACKGROUND OF THE INVENTION

1. Field of the Invention

The present invention generally relates to a method for achieving multiple beam radiation vertical orthogonal field coverage by means of multiple feed-in dish antenna; in particular, it relates to a method capable of creating multiple mutually vertical orthogonal radiation fields so that the generated energy radiation gains are all consistent thereby increasing the energy coverage of the electro-magnetic wave radiation environment and improving the transmission efficiency.

2. Description of Related Art

Because of rapid developments in mobile communication fields lately, multiple beam communication technology is now increasingly important, and in response to the imminent 5th generation mobile communication era, there seems to be a trend that the frequency bands utilized by antennas are moving toward high-frequency segments and the applications thereof are expected to extend into the range of millimeter waves (mmWave). For the millimeter wave frequency bands applied on satellite communications, the microwave wavelength and antenna structure thereof would become smaller, but significant losses are inevitable upon traveling in air, and in order to be adapted to the concept of multi-application and multi-channel, it is hoped the utilization of multiple beams can be effectively achieved. Meanwhile, for implementing high-gained antennas, conventionally it is done by means of phase array antennas, especially emphasizing on the use of PCB or LTCC manufacture processes for embodying relevant hardware, and such manufacture processes have been the mainstreams in prior art mobile communication technology developments. However, in case that the required frequency bands in schedule belong to the mmWave field, quite a few challenges may be encountered with regard to technical details and hardware implementations; especially, in terms of relevant hardware for realizing 5G high-gained antennas (or radio frequency (RF) related technologies), the embodiments of array antenna may exhibit a large amount of energy losses thus further undesirably generating noise interferences.

The aforementioned issues may become more uncontrollable for active components, including that the changes or variations in amplitudes and RF phases are comparatively unstable, which may vary in accordance with ambient temperature, the scale of noises or even different manufacture batches. Especially, the implementations of array antenna require cooperative feed RF circuits and the constitution thereof may employ massive active components, while this type of circuits potentially leads to relatively significant energy losses in millimeter waves. Consequently, to maintain the required antenna gain, the number of antenna units has to be increased; for example, in case the antenna circuit loss is 3 dB, the number of antenna units must be doubled thereby compensating the energy losses. Whereas, even the number of antenna units is doubled, the complexity in the RF feed circuits may further elevate, which results in more energy losses at the same time, so the actual number of antennas could become quite big. Moreover, the formation of beams in an array antenna needs phase variations from the phase shifter to attain the desired beam; but, in millimeter-wave frequency bands, active components and passive components all generate unstable phase differences, so the formation of the required beam could be pretty challenging.

Additionally, from another angle of view, in mobile communications, communication operations emphasize on the coverage of electro-magnetic waves. For the above-said 25 dBi antenna gain, under ideal conditions, we can first discuss the coverage issue in terms of so-called directivity, and the energy gain is equal to 100% at this point. However, in case of embodying such a 25 dB antenna directivity by means of an array antenna, the 3 dB beam width thereof would be approximately 9 degrees; suppose the antenna unit loses 3 dB due to the aforementioned reasons (i.e., 50% of energy losses), in order to compensate such losses, the number of antenna units needs to be doubled, thus the beam width may correspondingly become narrower, e.g., 5 degrees, which may greatly lessen the coverage range and significantly increase the complexity of the system. Besides, the energy losses in active circuits may further require more antenna units, thus further compressing the beam width and causing negative influences on the coverage.

Consequently, to overcome the above-said issues, it is possible to use the dish antenna and apply the multiple feed-in feature for implementing the multiple beam coverage function so as to enlarge the coverage range. In addition, to achieve the objective of multiple beam coverage, the antenna feed-in position needs to be deliberately moved away from the focusing point, i.e., to focus in an offset-focusing approach, so it is allowed to place several offset-focusing antennas to provide the multiple beam function. Moreover, through disc transformations, the focusing point of such an offset-focusing approach may be enlarged or transformed into a horizontal axis or vertical axis such that more antennas can be placed therein in order to implement the multiple beam antenna function. Therefore, using this type of offset-focusing dish antenna to achieve the goal of multiple beam coverage may resolve the issues described previously thereby providing an optimal solution.

SUMMARY OF THE INVENTION

As such, the present invention discloses a method for achieving multiple beam radiation vertical orthogonal field coverage by means of multiple feed-in dish antenna, which allows to create multiple mutually vertical orthogonal radiation fields so that the energy radiation gains generated by them are all consistent thereby increasing the energy coverage of the electro-magnetic wave radiation environment and improving the transmission efficiency.

The method for achieving multiple beam radiation vertical orthogonal field coverage by means of multiple feed-in dish antenna comprises:

(1) using a total metallic disc and plural feed-in antenna components capable of radiating electro-magnetic wave energy applicable for frequency bands of 37~39 GHz, initially analyzing the radiation waveform generated by one of the feed-in antenna components in order to acquire the highest gain and most suitable radiation beam width, and then making the highest gain and the most suitable radiation beam width correspond to the reflection face of the total metallic disc thereby obtaining the phase focusing center;

(2) by means of offset-focusing, making the feed-in antenna component corresponding to the phase focusing center of the total metallic disc not achieve the perfect focusing, and allowing other feed-in antenna components to extend in an axial fashion such that the radiation beams emitted from other feed-in antenna components can also utilize the phase focusing center of the total metallic disc;

(3) performing operations, finally, on the radiation beams generated by each of the feed-in antenna components thereby figuring out the coverage range and gain for each radiation beam, so that the coverage of multiple radiation beams can evenly distribute to create multiple vertical orthogonal radiation fields in order to use such multiple vertical orthogonal radiation fields to change the structure of the reflection face of the total metallic disc, thus achieving the objective of multiple beam radiation vertical orthogonal field coverage.

With regards to the aforementioned structure for changing the reflection face of a total metallic disc with multiple vertical orthogonal radiation fields, initially the reflection face of the total metallic disc comprises multiple feed-in components, and each of the feed-in antenna components is individually fed with electro-magnetic waves to generate a corresponding radiation field. For different relative angles of the reflection face on the total metallic disc, the feed-in antenna component can generate a field having a coverage and an adjustable beam orientation position due to the physic phenomenon that incident angle is equal to the reflection angle. The approach that the present invention applies the radiation field to modify the reflection face of the total metallic disc comprises: recording the radiation field of each feed-in antenna component, and, by means of algorithms, fixing the position of each feed-in antenna component, then altering the reflection face of the total metallic disc and observing the trend of such a modification thereby appreciating the direction for required adjustments. With such a design, it is possible to get the needed radiation field.

More specifically, the aforementioned adjusting the structure of the reflection face on the total metallic disc allows that each radiation beam has the features of equivalent gain, vertical orthogonality and low lateral radiation beam.

More specifically, the aforementioned analyzing the radiation waveform generated by one of the feed-in antenna components requires to first analyze and design the shape of the radial face on the reflection face by using the radiation waveform generated by one of the feed-in antenna components, and the shape equation for each point coordinate (x, y, z) of the radial face on the reflection face is shown as below:

$$x(t,\varphi)=a\cdot t\cos\varphi\cdot r(\varphi)xo$$

$$y(t,\varphi)=b\cdot t\cos\varphi\cdot r(\varphi)+yo$$

wherein (x(t,φ), y(t,φ)) indicates the projection coordinates of the reflection face on the x-y plane, (xo,yo) the projection center of the disc face thereof, and (t,φ) represents parameters in the radial direction and angular direction of the polar coordinate system on the x-y plane, in which the range of t is defined as $0\le t\le 1$ the range of ψ is $0\le\varphi\le 2\pi$, so that a and b respectively means the radius of the reflection boundary projected on the x axis and the y axis of the x-y coordinate plane, while the equation of r(φ) is shown as below:

$$r(\phi)=\frac{1}{(|\cos\phi|^{2v}+|\sin\phi|^{2v})^{1/2v}}$$

wherein the value of t indicates the boundary shape of the radial face, and the value of v can be used to control the boundary shape.

More specifically, the aforementioned analyzing and designing the shape of the reflection face can be performed, and the shape equation for the reflection face is shown as below:

$$z(t,\varphi)=\Sigma_{n=0}^{N}\Sigma_{m=0}^{M}(C_{nm}\cos n\varphi+D_{nm}\sin n\varphi)F_m^{\,n}(t)$$

wherein z(t,φ) represents the coordinate on the z axis, which can be obtained by using several triangular functions and the modified Jacobi polynomials as the basis functions for expansions, N and M indicate the terms of the applied basis functions, n and m represent the indices thereof to correspond to the applied basis functions (i.e., the triangular functions and the Jacobi polynomials), in which $C_{nm}$ and $D_{nm}$ are the coefficients of the series expansions, while $F_m^{\,n}(t)$ the modified Jacobi polynomials. Hence, it is possible to calculate $C_{nm}$ and $D_{nm}$ through integral equations and derive the highest gain and the most suitable radiation beam width by way of $C_{nm}$ and $D_{nm}$, and make the obtained highest gain and most suitable radiation beam width correspond to the reflection face of the total metallic disc thereby acquiring the phase focusing center.

More specifically, regarding to the aforementioned offset-focusing, the feed-in antenna component corresponding to the phase focusing center of the total metallic disc does not achieve the perfect focusing, but it is required to use an iteration procedure to adjust $C_{nm}$ and $D_{nm}$ so as to find out the coverage range and gain of each radiation beam. At the same time, the coverage of multiple radiation beams can uniformly distribute there between in order to generate the radiation field thus changing the structure of the reflection face on the total metallic disc with the radiation field.

More specifically, the aforementioned other feed-in antenna components may extend in a horizontally axial or vertically axial fashion.

More specifically, the aforementioned created multiple radiation fields must be mutually vertical orthogonal, and the method for achieving such a vertical orthogonality comprises:

(1) defining the relative positions of the feed-in antenna components and the total metallic disc;

(2) adjusting the curvature of the total metallic disc such that the focusing point transforms from a point to an axis, and the gain and the beam width of each of the feed-in antenna components through the radiation field of the total metallic disc become consistent;

(3) adjusting further the intervals between each of the feed-in antenna components such that the highest point of the energy in the radiation field of one feed-in antenna component is located at the zero-point position of the radiation field of another feed-in antenna component, thus achieving the objective of multiple beams and radiation field vertical orthogonality.

More specifically, the aforementioned feed-in antenna component may be an output component capable of radiating electro-magnetic wave energy applicable for the required frequency bands, and the required frequency bands may range 37~39 GHz.

More specifically, the aforementioned feed-in antenna component is a lens-typed horn antenna and includes a metallic waveguide, and the opening at the top end of the waveguide has a dielectric structure including a top edge and a bottom edge, in which the bottom edge of the dielectric structure is connected to the opening at the top end of the waveguide, and the bottom edge of the dielectric structure has a curve toward the top edge.

More specifically, the aforementioned dielectric structure may be made of materials enabling electro-magnetic wave penetration, effect of low losses as well as phase variation effect of electro-magnetic wave radiation field.

More specifically, the dielectric feature in the dielectric structure of the aforementioned feed-in antenna component allows the gains, the radiation beam widths and polarization differences obtained by all the feed-in antenna components to be consistent.

More specifically, the energy radiation gain that each aforementioned feed-in antenna component can generate must be equivalent.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
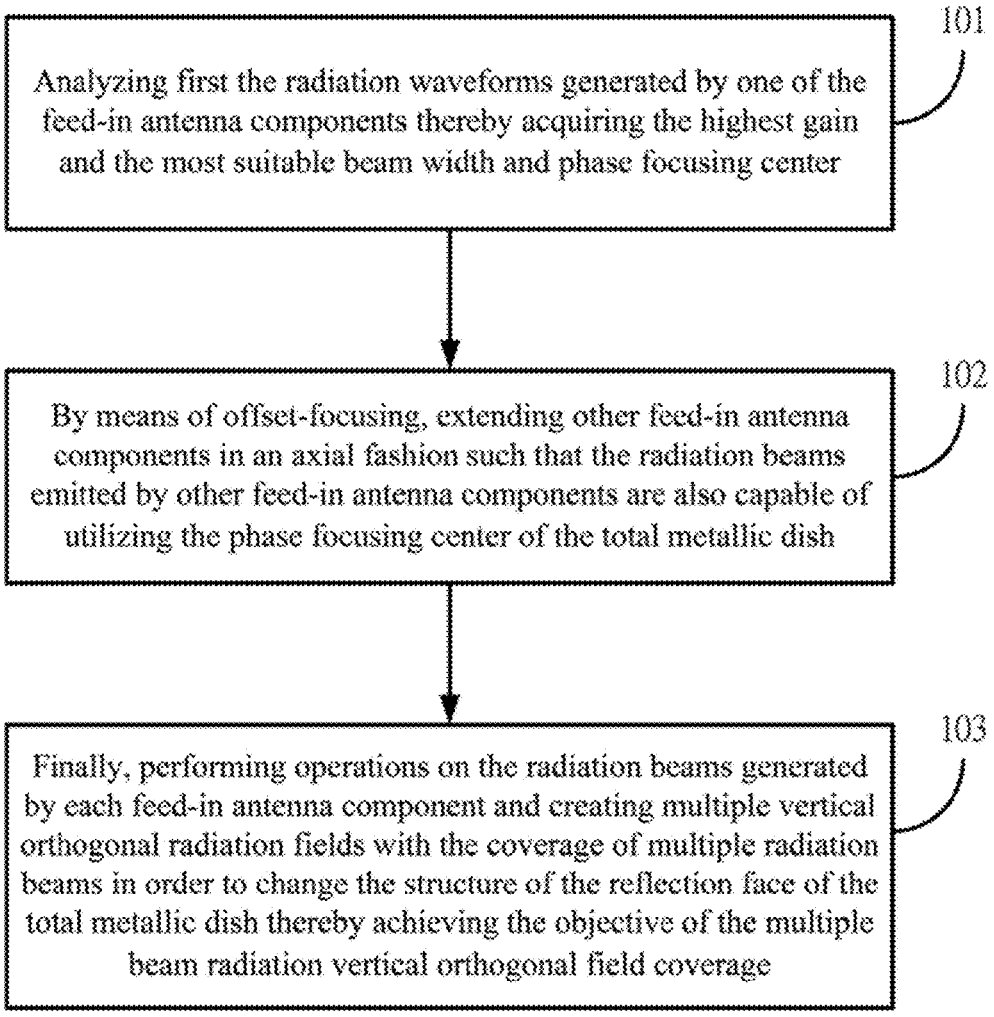
FIG. 1 shows a flowchart of the method for achieving multiple beam radiation vertical orthogonal field coverage by means of multiple feed-in dish antenna according to the present invention.

Refer initially to FIG. 1, wherein a flowchart of the method for achieving multiple beam radiation vertical orthogonal field coverage by means of multiple feed-in dish antenna according to the present invention is shown. It can be appreciated from the Figure that the steps thereof includes:

(1) using a total metallic disc and plural feed-in antenna components capable of radiating electro-magnetic wave energy applicable for frequency bands of 37~39 GHz, initially analyzing the radiation waveform generated by one of the feed-in antenna components in order to acquire the highest gain and most suitable radiation beam width, and then making the highest gain and the most suitable radiation beam width correspond to the reflection face of the total metallic disc thereby obtaining the phase focusing center (101);

(2) by means of offset-focusing, making the feed-in antenna component corresponding to the phase focusing center of the total metallic disc not achieve the perfect focusing, and allowing other feed-in antenna components to extend in an axial fashion such that the radiation beams emitted from other feed-in antenna components can also utilize the phase focusing center of the total metallic disc (102);

(3) performing operations, finally, on the radiation beams generated by each of the feed-in antenna components thereby figuring out the coverage range and gain for each radiation beam, so that the coverage of multiple radiation beams can evenly distribute to create multiple vertical orthogonal radiation fields in order to use such multiple vertical orthogonal radiation fields to change the structure of the reflection face of the total metallic disc, thus achieving the objective of multiple beam radiation vertical orthogonal field coverage (103).

Figure 2:
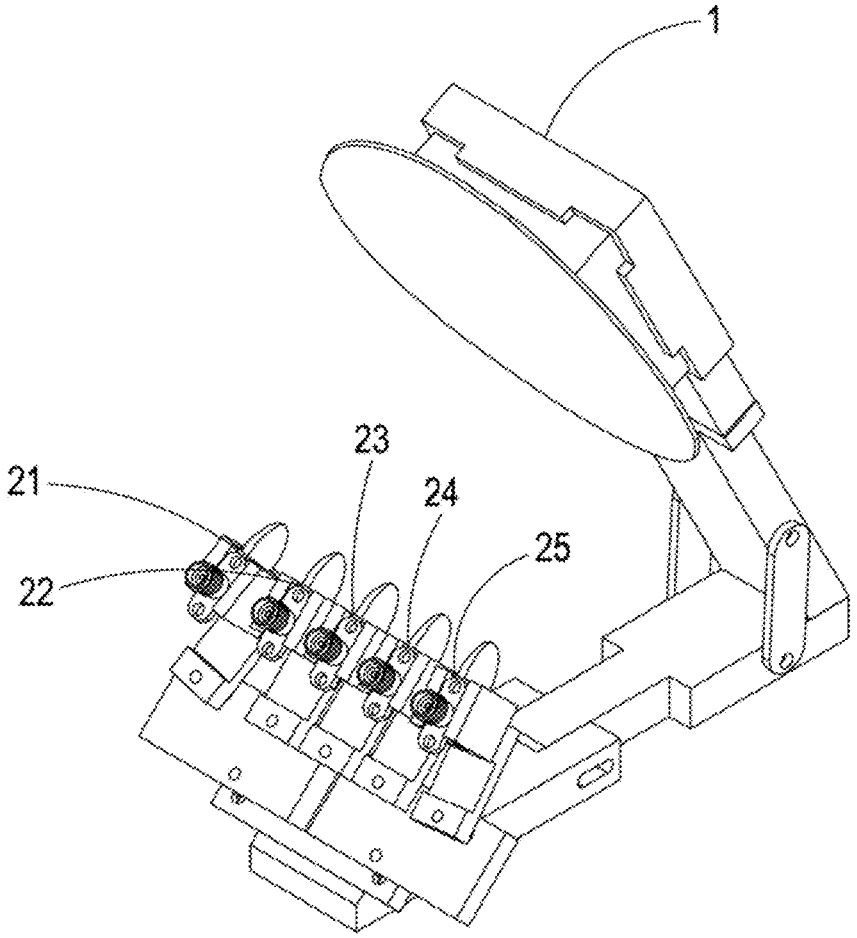
FIG. 2 shows an integral implementation structure view of the method for achieving multiple beam radiation vertical orthogonal field coverage by means of multiple feed-in dish antenna according to the present invention.

Next, from FIG. 2, it can be seen that the integral structure thereof applies a mechanism to support the position of the disc such that the relative angle with respect to the feed-in antenna components 21, 22, 23, 24, 25 (i.e., the feed-in antenna) can be maintained at a fixed value. After completing the antenna design, in order to make feed-in antenna components 21, 22, 23, 24, 25 correspond to the focusing point of the total metallic disc 1, since in implementation the feed-in antenna components 21, 22, 23, 24, 25 and the total metallic disc 1 are not integrally formed, but, on the contrary, individually fabricated, it is necessary to configure a mechanism for adjusting the angle, location and distance of the total metallic disc 1 (i.e., the dish antenna) with respect to the feed-in antenna components 21, 22, 23, 24, 25, thus providing such a mechanism applicable for dish antenna design.

It should be noticed that the differences between the lens-typed horn antenna utilized in the present invention and general horn antennas exist in that, in the multiple radiation beam antenna design, there are several feed-in antennas configured in mutual adjacency, while the waveguide opening of a general horn antenna may be in a form of a curved square, a cone or a pyramid; however, to expand the polarization difference and control the radiation beam width, people may increase the layers of the opening as well as the height of the layers in the general horn antenna, so the antenna structure thereof may gradually become huge due to such an increase in layers.

Therefore, upon applying the general horn antenna on multiple radiation beam antenna designs, in order to get the multiple radiation beam effect, multiple feed-in antenna components are needed, so several antennas have to be installed in the focusing range of the dish antenna to complete a multiple radiation beam antenna architecture, indicating the sizes of such antenna components may be significantly influential. By using the general horn antennas, due to their volumes, the dilemma that the incompatibility issue and excessively small intervals between these antennas may occur, so that the isolation and the radiation field among them may also deteriorate and the variables enabling adjustments for the radiation fields to obtain the intended vertical orthogonality may be smaller.

Figure 3:
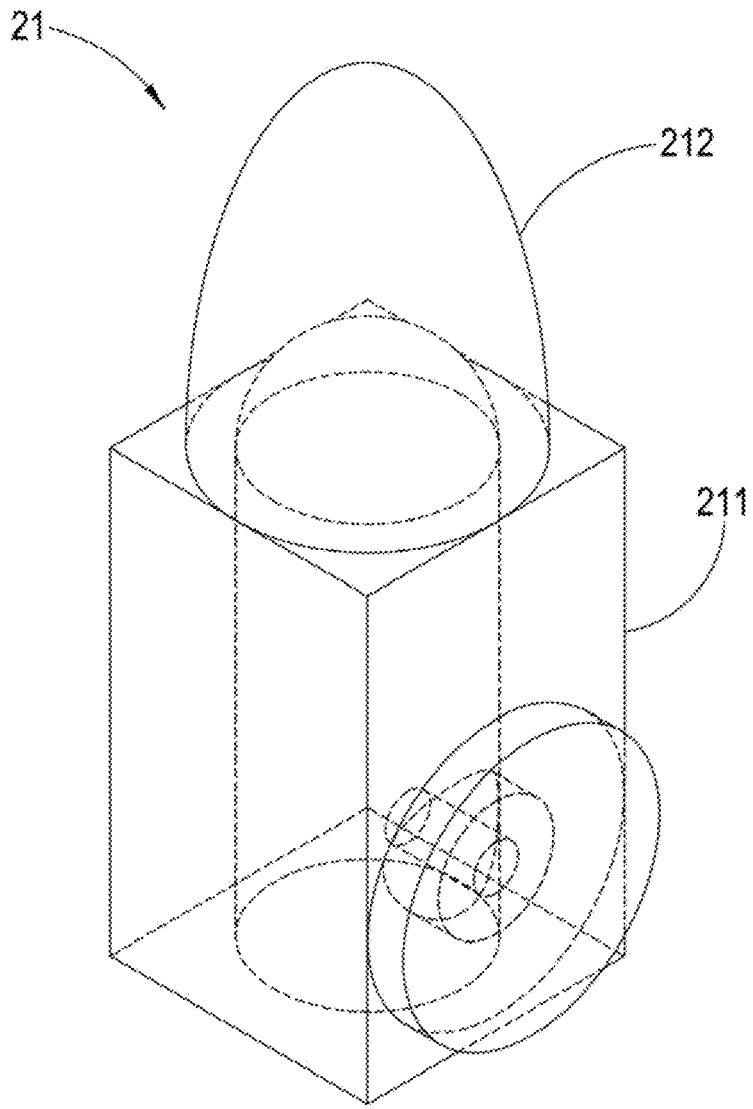
FIG. 3 shows a structure view of a lens-typed horn antenna in the method for achieving multiple beam radiation vertical orthogonal field coverage by means of multiple feed-in dish antenna according to the present invention.

Hence, the present invention needs to develop new components to reduce the volume, and the most critical point is to lessen the cross-sectional area; i.e., the configuration optimization particularly on the horn opening part, so the lens-typed antenna may be the most suitable option for cross-sectional area reduction. The detailed structure of the feed-in antenna components 21, 22, 23, 24, 25 shown in FIG. 2 can be set forth in conjunction with the lens-typed horn antenna illustrated in FIG. 3 (herein, duo to the reason of assemblage, certain parts are not denoted in FIG. 2, so it requires to see FIGS. 2 and 3 collectively, and also since the feed-in antenna components 21, 22, 23, 24, 25 have the same detailed structure, only the feed-in antenna component 21 is exemplarily described for brevity.) It can be seen that the feed-in antenna component 21 includes a metallic waveguide 211, the opening on the top end of the waveguide has a dielectric structure 212, and the surface of the dielectric structure 212 has a curve and the volume thereof becomes smaller as gradually going up.

The feed-in antenna components 21, 22, 23, 24, 25 of the present invention can provide a feature of electro-magnetic wave arrangement through the dielectric structure 212 because of the dielectric material applied in the dielectric structure 212 on the top end (e.g., polyvinyl chloride (PVC), but by no means limited thereto; other materials may be applicable for the configuration as well, so long as it enables the features of electro-magnetic wave penetration and low losses and creates phase variations in the electro-magnetic wave radiation field), and this kind of structure can also effectively allow area reduction, while such effects can not be achieved by general horn antennas completely made of metallic materials.

Figure 4:
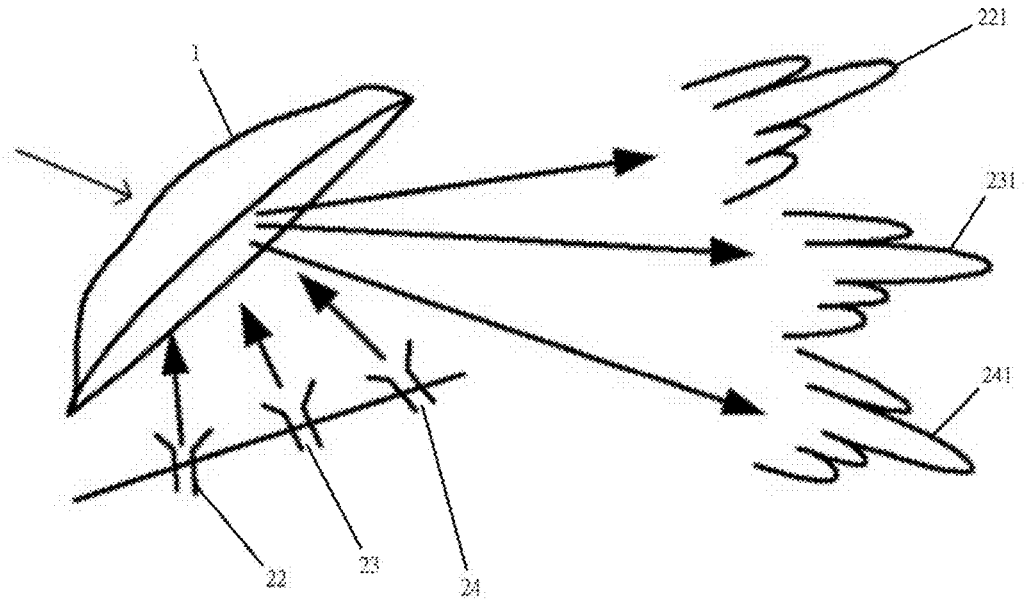
FIG. 4 shows a view of multiple radiation beams in the method for achieving multiple beam radiation vertical orthogonal field coverage by means of multiple feed-in dish antenna according to the present invention.

Besides, to lessen the number of antennas in ground reception stations, to reduce costs or to divide the coverage area in wireless communications, it hence requires to utilize multiple radiation beam coverage to expand the communication capacity, employing a single antenna for multiple satellite communication or even the point-to-point microwave transmission technology development in the future, so the formation of multiple radiation beam can be momentous. Consequently, the present invention utilizes several feed-in antenna components 21, 22, 23, 24, 25 (i.e., the feed-in antenna) to implement the multiple radiation beams, while each feed-in antenna component 21, 22, 23, 24, 25 is responsible for creating a radiation beam (wherein FIG. 4 simply takes the range of the feed-in antenna components 22, 23, 24, and it can be seen from the Figure that the electro-magnetic waves generated by the feed-in antenna components 22, 23, 24 can further create the radiation waveform (radiation beams 221, 231, 241) via the reflection face of the total metallic disc 1), thereby obtaining the mutually vertical orthogonality among such radiation beams in order to realize the optimal coverage.

However, in practice, seeing that the total metallic disc 1 (i.e., the dish antenna) has only one focus and this focus can only accommodate one feed-in antenna component (i.e., the feed-in antenna), it is necessary to apply an offset-focusing approach for placing other feed-in antenna components (i.e., the feed-in antennas) and the installation of such feed-in antenna components 21, 22, 23, 24, 25 is shown in FIG. 2. Generally speaking, in case the position of the feed-in antenna component 21, 22, 23, 24, 25 deviates from the focus, we can refer this situation as "defocusing", and the generated radiation beam may exhibit lowered performance; for example, the antenna gain thereof may be reduced.

In order to let all radiation beams have the performance of equivalent magnitude, it is necessary to use the transformation of the disc to optimize the antenna radiation such that the each of the radiation beams has the equal gain as well as lowered lateral radiation beam, in which the multiple radiation beam antenna structure should acquire the same gain. The controls over the equality of gain among the radiation beams can be set forth hereunder:

(1) it is required to define first the relative positions of the feed-in antenna components and the total metallic disc 1;

(2) then adjust the curvature of the total metallic disc such that the focusing point transforms from a point to an axis, and the gain and the beam width of each of the feed-in antenna components through the radiation field of the reflection face become consistent;

(3) the algorithm employed in the present invention essentially comprises figuring out the trend for optimization, then, through the try-and-error approach, defining first the target coefficients, and applying the disc curvature adjustment to make the solution thereof approach incessantly to the target; upon the solution reaching a limit value, changing the curved face of the disc modified vertically to the first stage and creating another variable so as to have better chance to attain the goal; otherwise, without adjustments on equal gain among the radiation beams, it is very likely to encounter situations that certain radiation beams have higher gains while the gains of others may be less, and it is impossible to provide the same coverage rate under such conditions.

It should be known that, before actually applying the present invention for physical tests, it is possible to use simulations to configure the lens-typed horn antenna and the desired disc face. Herein the approach of numerical analyses can be utilized to simulate an intended lens-typed horn antenna, then further using the approach of numerical analyses to simulate the suitable disc and obtaining numerical analysis data which allow to be examined to see whether the required specifications are satisfied. Next, applying the electro-magnetic simulation software on the horn antenna to design functions equivalent to the above-said numerical analysis data and placing the antenna into the disc so as to check whether the same results can be obtained by means of electro-magnetic simulations. Hence, completed suppose the obtained results are acceptable; otherwise, changing once again the simulated antenna or the disc in the numerical analyses.

In performing numerical analyses, it needs first to respectively set a fixed value to the gain and the radiation beam width to analyze the lens-typed horn antenna numerically, then infer back to the cross-sectional area of the opening in the lens-typed horn antenna and the size of the antenna, and place them into the electro-magnetic simulation software for verifications. Now, with respect to a total metallic disc, initially using a value for the horn antenna, it applies the total metallic disc in a mathematic way to the lens-typed horn antenna for simulations thereby locating the values of its highest gain and most suitable radiation beam width, so that the size and position of the disc corresponding to the values indicate the phase focusing center. Following this, extending other horn antenna in an axial fashion, using the optimization method to find out the coverage range and gain of each radiation beam, while keeping that the disc has one single phase focusing center. Therefore, the offset-focusing approach can be employed to make the horn antenna at the center not achieve the perfect focusing condition, and allow other radiation beams to use the phase focusing center of the dish antenna as well, then finally place them into the electro-magnetic simulation software for verifications.

With regard to the aforementioned offset-focusing process, there are essentially three types of structures for the reflection face of the total metallic disc 1, respectively explained as below:

The first type is characterized in that the feed-in antenna components on the reflection face of the total metallic disc 1 are located at the very center in the reflection face of the total metallic disc, which can be referred as the reflection face of the central feed-in total metallic disc 1. This type of reflection face of the total metallic disc 1 can be conveniently designed, needing only to place the feed-in antenna components at the center, the fields radiated by the feed-in antenna components can concentrate the energy right at the phase focusing center in the reflection face of the total metallic disc 1, and high gain and high directivity effects can be easily achieved based on the property of electro-magnetic wave reflection by the total metallic materials. However, with such an approach, the feed-in antenna components are all located in the path of reflection energy from the reflection face of the total metallic disc, so the energy losses are expected in comparison with other two types due to the existence of physical structures of the feed-in antenna components. Also, this kind of structure may not enable the intended multiple feed-in configuration because that, when several feed-in antenna components are all placed in the energy radiation path from the reflection face of the total metallic disc, large amount of energy losses may occur. Accordingly, this type of structural design is not an option for the present application.

The second form of structure is the offset-focusing feed-in method of the present invention, in which the feed-in antenna components are moved away from the path of reflected radiation energy from the reflection face of the total metallic disc such that the feed-in antenna components do not affect the generated radiation fields, and this type of structure also enables multiple feed-in applications. The last type is referred as a bi-dish antenna structure, in which the opening of the feed-in antenna component is placed in parallel to the reflection face of the total metallic disc, and the feed-in antenna components are installed in the reflection face of the total metallic disc, then another smaller reflection disc is set up on the antenna radiation path. The purpose thereof is that the energy coming from the feed-in antenna component radiation can exhibit the effect of high directivity by means of two reflections. The present invention adopts the second type of structure implementing the offset-focusing method.

Furthermore, seeing that the reflection face of the total metallic disc 1 includes multiple feed-in components and each feed-in antenna component individually emits electro-magnetic waves thus generating a corresponding radiation field, suppose the relative angle of the feed-in antenna component with respect to the reflection face of the total metallic disc varies, then, based on the physical phenomenon that the incident angle is equal to the reflection angle, a field having a coverage and an adjustable beam directivity position can be created. The approach that the present invention applies the radiation field to modify the reflection face structure of the total metallic disc comprises: recording the radiation field of each feed-in antenna component, and, by means of algorithms, fixing the position of each feed-in antenna component, then altering the reflection face of the total metallic disc and observing the trend of such a modification thereby appreciating the direction for required adjustments. With such a design, it is possible to acquire the desired radiation field, and the illustrations for relevant algorithms are described in details as below.

The generation of multiple radiation beams by means of the dish antenna system according to the present invention essentially concerns the applications of analyses and syntheses. The so-call "analyses" involve in calculations on the radiation waveforms generated by the electro-magnetic waves emitted by the feed-in antenna components through the reflection face of the total metallic disc 1, and the technique of "syntheses" concerns applications for finding out an appropriate shape for the reflection face so as to re-distribute the energy such that radiation waves mutually react to create the desired equivalent radiation beams or multiple radiation beams. In terms of analyses, the present invention employs the physical optics (PO) to find out the radiation waveforms, whose principle basically lies in that the electro-magnetic field generated by the feed-in antenna component can cause equivalent current on the reflection face, thus creating the radiation waveforms. But it should be noticed that herein the difference from general applications of the PO method is that the numerical integration section in the PO method utilized in the present invention can be alternatively processed by means of the Gaussian Beam technique, such that the numerical integration can be entirely omitted thus allowing comparatively faster analysis speed, in particular with regard to reflection faces of larger sizes. On the other hand, regarding to the synthesis procedure, the present invention employs the improved steepest decent method (ISDM).

Figure 5:
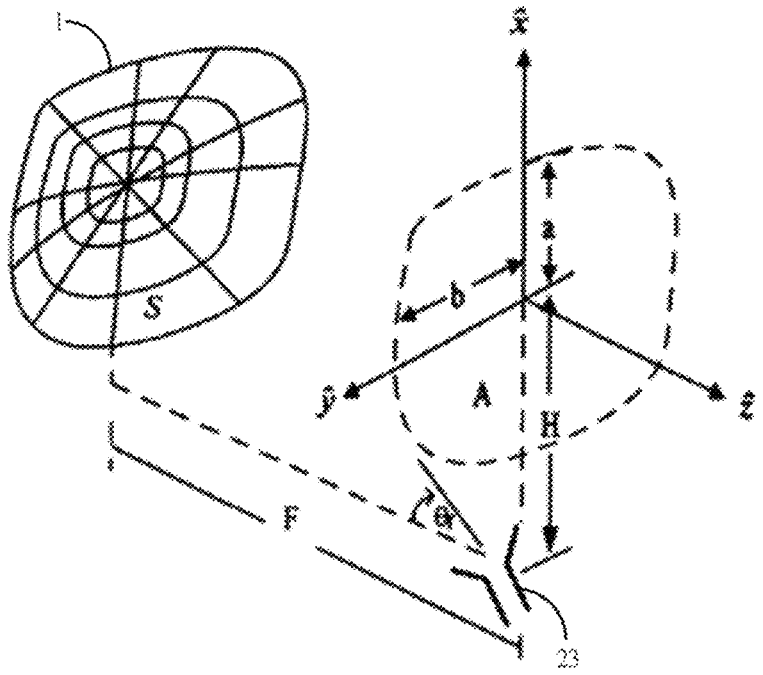
FIG. 5 shows a geometric architecture view of a dish antenna system in the method for achieving multiple beam radiation vertical orthogonal field coverage by means of multiple feed-in dish antenna according to the present invention.

Accordingly, in order to analyze the radiation waveform generated by one of the feed-in antenna components, it requires to first analyze and design the shape of the radial face on the reflection face by using the radiation waveform generated by one of the feed-in antenna components, and the shape equation for each point coordinate (x, y, z) of the radial face on the reflection face is shown as below (refer conjunctively to the geometric architecture view of the transformed dish antenna system shown in FIG. 5):

$$x(t,\varphi)=a\cdot t\cos\varphi\cdot r(\varphi)+xo$$

$$y(t,\varphi)=b\cdot t\cos\varphi\cdot r(\varphi)+yo \tag{1}$$

wherein $(x(t,\varphi),y(t,\varphi))$ indicates the projection coordinates of the reflection face on the x-y plane, (xo,yo) the projection center of the disc face thereof, and $(t,\varphi)$ represents parameters in the radial direction and angular direction of the polar coordinate system on the x-y plane, in which the range of t is defined as $0\le t\le 1$, the range of $\varphi$ is $0\le\varphi\le 2\pi$, so that a and b respectively means the radius of the reflection boundary projected on the x axis and the y axis of the x-y coordinate plane, while the equation of $r(\varphi)$ is shown as below:

$$r(\phi)=\frac{1}{(|\cos\phi|^{2v}+|\sin\phi|^{2v})^{1/2v}} \tag{2}$$

Herein when t=1, it describes the boundary shape of the radial face, and v can control the boundary shape. The advantage of the above-said expressions lies in that the boundary of the radial face can be very smooth, which is suitable for applying Gauss beam method to analyze the surface scattering issues.

Afterward, it can analyze and configure the shape of the reflection face by using the Jacobi-Fourier series, in which the shape function of the reflection face can be expressed hereunder:

$$z(t,\varphi)=\Sigma_{n=0}^{N}\Sigma_{m=0}^{M}(C_{nm}\cos n\varphi+D_{nm}\sin n\varphi)F_m^{\,n}(t) \quad (3)$$

wherein z(t,φ) represents the coordinate on the z axis, which can be obtained by using several triangular functions and the modified Jacobi polynomials as the basis functions for expansions, N and M indicate the terms of the applied basis functions, n and m represent the indices thereof to correspond to the applied basis functions (that is, the above-said triangular functions and Jacobi polynomials), in which $C_{nm}$ and $D_{nm}$ the coefficients of the series expansions, while $F_m^{\,n}(t)$ the modified Jacobi polynomials. As a result, it is possible to calculate $C_{nm}$ and $D_{nm}$ through integral equations and derive the highest gain and the most suitable radiation beam width by way of $C_{nm}$ and $D_{nm}$, and make the obtained highest gain and most suitable radiation beam width correspond to the reflection face of the total metallic disc thereby acquiring the phase focusing center.

Therefore, through the aforementioned equations, the incident electro-magnetic field emitted by the feed-in antenna components can be reflected into the predetermined radiation fields. After that, the improved steepest decent method (ISDM) can be applied to perform the iteration procedure for syntheses, and the ISDM can be divided into two iteration procedures, one of them is the original SDM procedure, while the other one an iteration procedure having increased number of variables. At first, a fewer number of variables are used to calculate the value of the cost function, then gradually increasing the number of variables in the subsequent iteration procedures thereby getting the global minimum. In executing the reflection face syntheses of the disc, the cost function defined by the SDM iteration procedure can be expressed as:

$$\varphi=\Sigma_{j=1}^{N_S}fj|G_j-G_j^d|^2 \quad (4)$$

in which $N_S$ represents the number of sample points in the observation point area, $G_j$ indicates the calculated antenna gain of the total metallic disc 1 (the dish antenna) in the j direction, and $G_j^d$ the gain of the target.

Herein the values of the lateral radiation beam and the cross-polarization are controlled by the value of $G_j^d$, and the components of the co-polarization and the cross-polarization are respectively considered by on two gains; besides, the weight fj introduced in the cost function defined by the SDM iteration procedure allows to emphasize the specifically interested gain.

Meanwhile, in Equation (3), the unknown coefficients $C_{nm}$ and $D_{nm}$ in the equation for the shape of the reflection face need to be adjusted such that the minimum of φ can be obtained.

Additionally, since the ISDM is based on the structure of the SDM, in the direction of the gradient of the cost function, it is possible to modify the coefficients $\beta_i$ of the series expansion describing the reflection face of the disc (here $\beta_i$ is used to express $C_{nm}$ or $D_{nm}$, wherein i indicates the index nm), and to minimize the value of the cost function, $\beta_i$ can be derived in the (k+1)th iteration procedure via the following equation:

$$\begin{bmatrix}\beta_1(k+1)\\ \beta_2(k+1)\\ \vdots\\ \vdots\\ \beta_Q(k+1)\end{bmatrix}=\begin{bmatrix}\beta_1(k)\\ \beta_2(k)\\ \vdots\\ \vdots\\ \beta_Q(k)\end{bmatrix}=\begin{bmatrix}\left.\frac{\partial\Phi}{\partial\beta_1}\right|_{\beta_1=\beta_1(k)}\\ \left.\frac{\partial\Phi}{\mu\partial\beta_2}\right|_{\beta_2=\beta_2(k)}\\ \vdots\\ \vdots\\ \left.\frac{\partial\Phi}{\partial\beta_Q}\right|_{\beta_Q=\beta_Q(k)}\end{bmatrix} \quad (5)$$

In the aforementioned Equation (5), μ is a scalar factor, so it is possible to find the minimum of φ by suitably selecting the value of μ; also, the right hand side of Equation (5) describes the gradient term of φ, and Equation (5) expresses the term causing φ to decrease the most in the Q-dimensional space. In general, the initial value of μ is set to be the reciprocal of the gradient φ.

Figure 6:
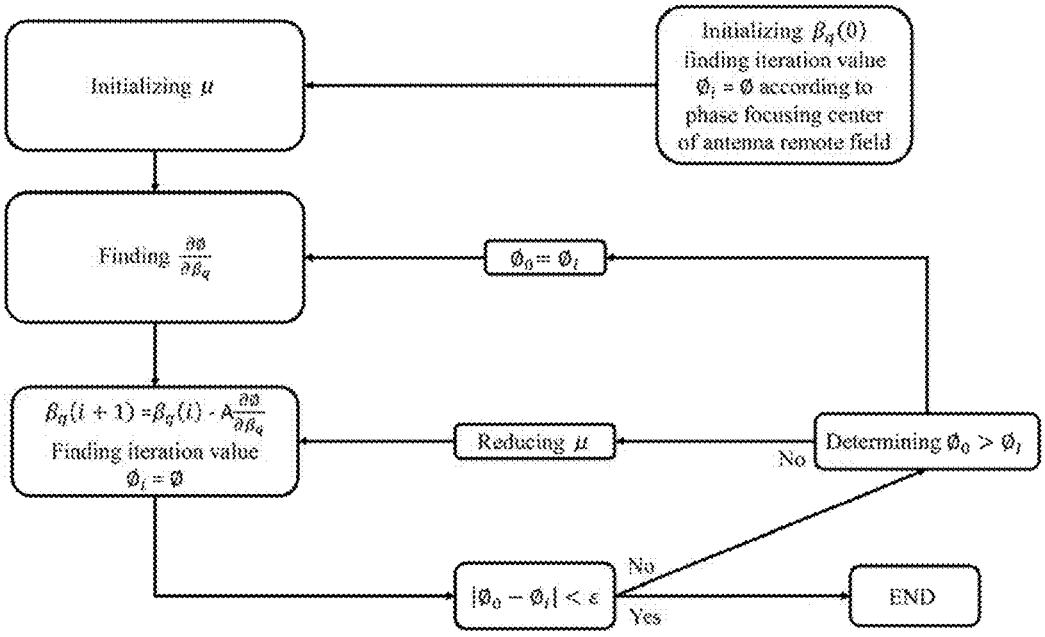
FIG. 6 shows a flowchart of the improved steepest decent method applied in the method for achieving multiple beam radiation vertical orthogonal field coverage by means of multiple feed-in dish antenna according to the present invention.

FIG. 6 shows the ISDM procedure. The outer iteration procedure of the ISDM changes the number of variable coefficients and starts with some simple assumptions requiring certain coefficients to represent the shape of the disc reflection face (e.g., for a round radial face, simply C00, C01 and D10), then gradually increases the number of variable coefficients until all Q coefficients have been taken.

Meanwhile, the SDM executes the inner iteration procedure until the local minimum is found; once the local minimum is located, one term in the Q coefficient will be added into the iteration procedure and the inner SDM iteration will be executed once again. The value acquired from the local minimum will be set as the start for another round of the iteration procedure, and such a repetition can be continuously performed until all Q coefficients are included into the optimization procedure, so a more generalized global minimum can be derived.

Besides, it needs to emphasize that adding the high-ordered terms of Equation (3) can re-distribute the power radiated by the transformed disc reflection face thereby better optimizing the cost function.

Through the operations of the above-said equations, it is possible to design a disc applicable for the operation frequency, place the lens-typed horn antenna in an offset-focusing fashion, then install the five feed-in antenna components 21, 22, 23, 24, 25 as shown in FIG. 2 without creating destructive interferences in the coupling generation of each feed-in antenna, and make the fields thereof be partially overlapped. However, since the focusing position is not located at the main focus, the energy gain could be weaker. With this type of horn antenna combination, although being adjacent, they do not generate coupling effect to cause mutual interferences, that is because all of them can emit directive radiations and do not engage with each other, so, in general, good isolation can be maintained. Furthermore, the intervals between the five feed-in antenna components 21, 22, 23, 24, 25 need to be configured such that the vertical orthogonal fields can be created among them and related angles can be well modified by means of antenna measurement tools thereby enabling the adjustability for each antenna.

The adjustment processes for the vertical orthogonality of the present invention are set forth hereunder:

(1) initially, defining the relative positions of the feed-in antenna components 21, 22, 23, 24, 25 with respect to the total metallic disc 1, then tuning the curve of the total metallic disc 1 thereby transforming its focusing point from a point into an axis, and making the gain and the beam width from each of the feed-in antenna components 21, 22, 23, 24, 25 via the radiation field of the total metallic disc 1 become consistent;

(2) next, adjusting the intervals among such feed-in antenna components 21, 22, 23, 24, 25, which comprises, first, fixing the position of the feed-in antenna component 23 with respect to the center, then placing another feed-in antenna component 24 on one side and adjusting its position first such that the highest point of energy in the radiation field from the second feed-in antenna component 24 is located right at the zero-point position of the radiation field from the first feed-in antenna component 23;

(3) following this, placing the third feed-in antenna component 22 on the other side of the first feed-in antenna component 23 and then repeating the aforementioned Step so as to place and adjust the field in a symmetric fashion until all of the feed-in antenna components 21, 22, 23, 24, 25 have been installed, thereby achieving the desired multiple beam and radiation field vertical orthogonal reflection antenna.

Also, the reflection face of the total metallic disc 1 can be further examined. It can be seen that the reflection face is not of a perfect curve profile, but instead an elliptical shape extending more toward the horizontal axis, the reason for this lies in that the radiation field of the feed-in antenna will be projected onto the disc and the antenna consists of five feed-in antenna components 21, 22, 23, 24, 25, so it requires an offset action on them such that the axis of their offsets can be completely equivalent to the axis of changed curve of the reflection face. The first major reason for this modification is that the angle of reflection needs to be adjusted so as to meet the standard of the coverage range specification and enable the mutual vertical orthogonality among such radiation beams, and the second reason is that, in order to make the gains reflected from each of the fed antennas attain a consistent standard, so the curve of the disc has to be changed.

Figure 7:
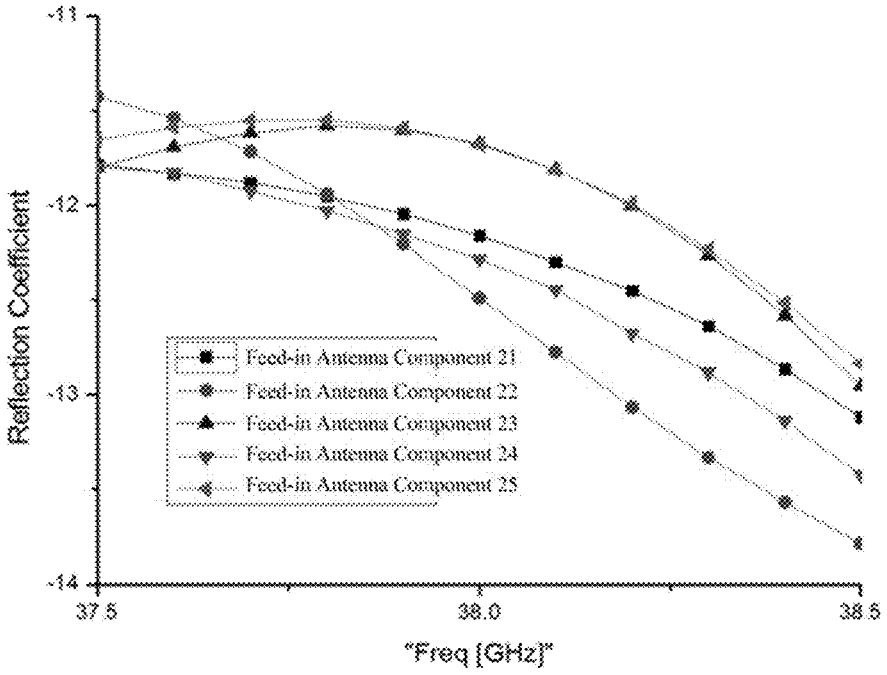
FIG. 7 shows a view of reflection coefficients obtained by a multiple beam dish antenna in the method for achieving multiple beam radiation vertical orthogonal field coverage by means of multiple feed-in dish antenna according to the present invention.

FIG. 7 shows the reflection coefficient values respectively for the five fed antennas in the present structure. Herein, for the feed-in antenna component 21 and feed-in antenna component 25, the reflection coefficient values are both −11.67 dB, worst at the operation frequency 38 GHz; the reflection coefficient value of the feed-in antenna component 24 is −12.27 dB at the operation frequency 38 GHz; the reflection coefficient value of the feed-in antenna component 23 is −12.16 dB at the operation frequency 38 GHz; and the reflection coefficient value of the feed-in antenna component 22 is −12.49 dB at the operation frequency 38 GHz. Apparently, the performance of reflection coefficient from the feed-in antenna component 22 is the best.

Figure 8A:
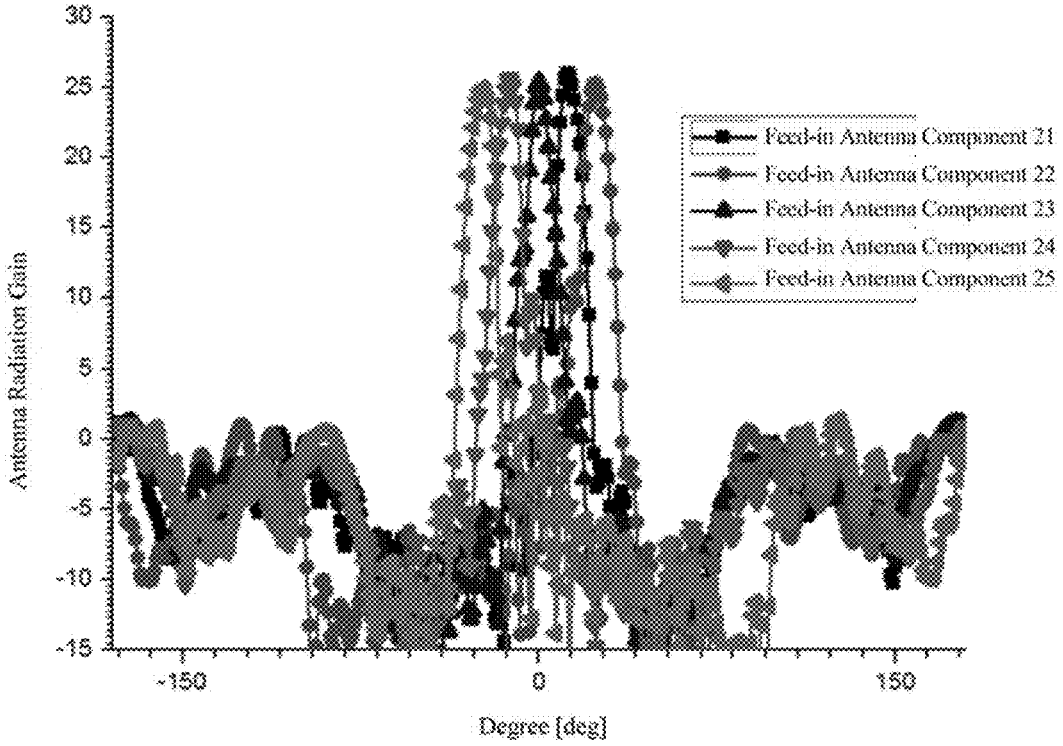
FIG. 8A shows a view of a 38 GHz multiple radiation beam dish antenna field in the method for achieving multiple beam radiation vertical orthogonal field coverage by means of multiple feed-in dish antenna according to the present invention.

Further with FIG. 8A, a field view of the multiple radiation beam dish antenna at 38 GHz is shown. It should be known that such feed-in antenna components are fed sequentially to generate radiation beams, rather than simultaneously. The angles and radiation beam widths of the generated main radiation beam upon feeding are illustrated as below:

(1) When feeding the feed-in antenna component 21, the angle of the main radiation beam thereof is 24 degrees, and the radiation beam width at −10 dB is 12 degrees;

(2) When feeding the feed-in antenna component 22, the angle of the main radiation beam thereof is 12 degrees, and the radiation beam width at −10 dB is 11.7 degrees;

(3) When feeding the feed-in antenna component 23, the angle of the main radiation beam thereof is 0 degree, and the radiation beam width at −10 dB is 11.6 degrees;

(4) When feeding the feed-in antenna component 24, the angle of the main radiation beam thereof is −12 degrees, and the radiation beam width at 10 dB is 12.3 degrees;

(5) When feeding the feed-in antenna component 25, the angle of the main radiation beam thereof is −24 degrees, and the radiation beam width at 10 dB is 13.4 degrees.

Figure 8B:
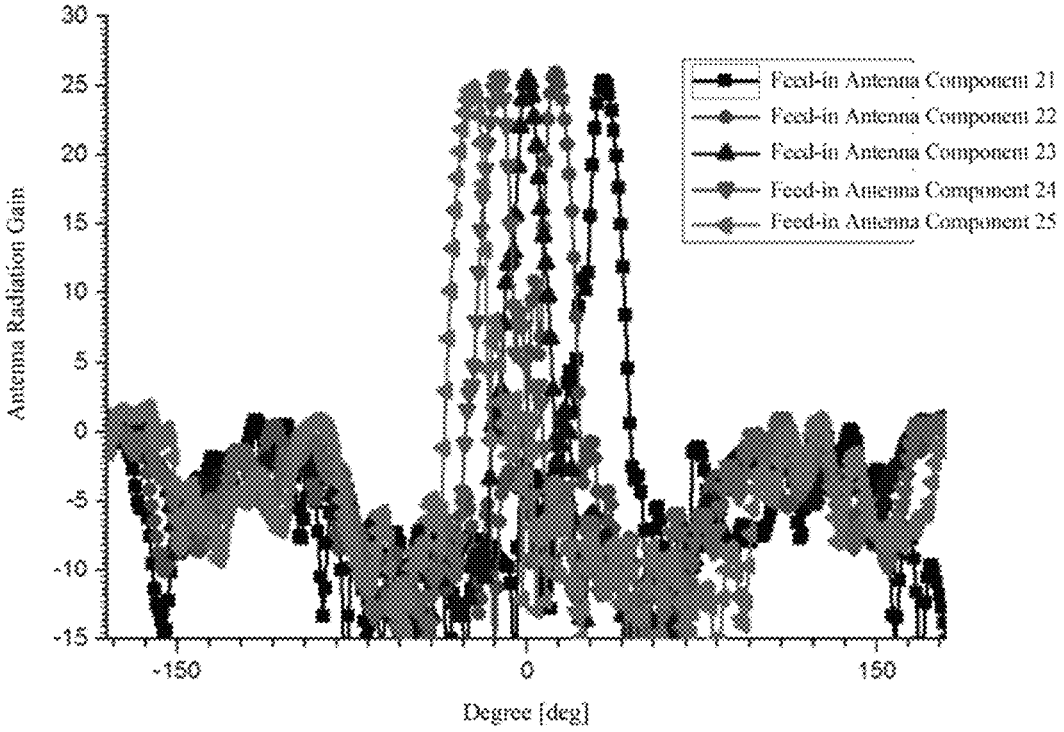
FIG. 8B shows a view of a 37.5 GHz multiple radiation beam dish antenna field in the method for achieving multiple beam radiation vertical orthogonal field coverage by means of multiple feed-in dish antenna according to the present invention.
Figure 8C:
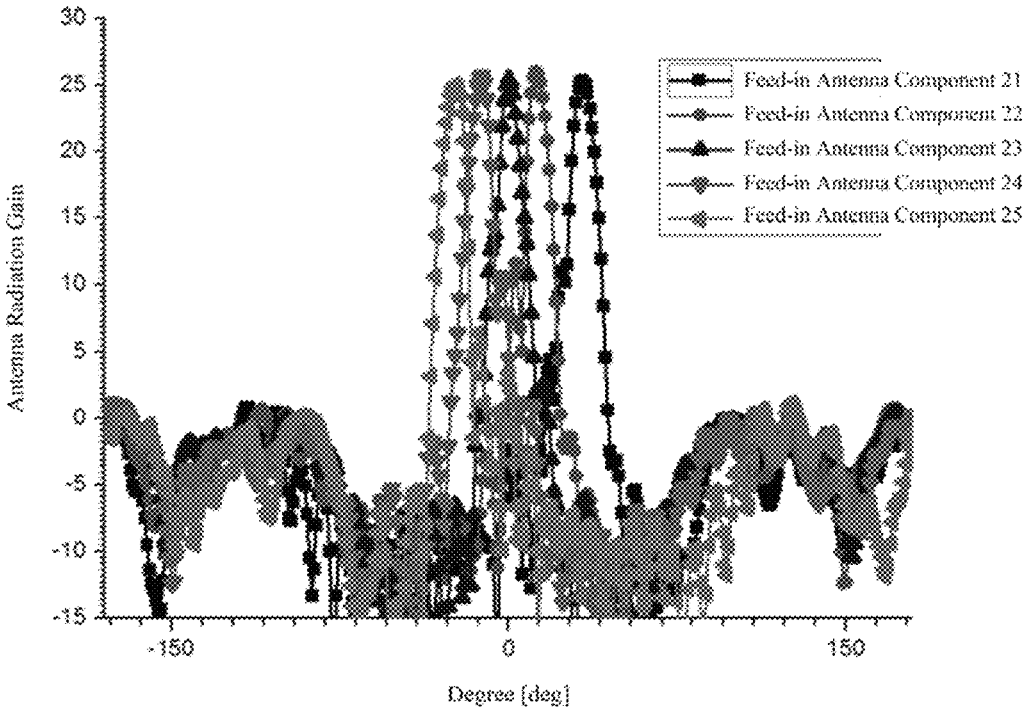
FIG. 8C shows a view of a 38.5 GHz multiple radiation beam dish antenna field in the method for achieving multiple beam radiation vertical orthogonal field coverage by means of multiple feed-in dish antenna according to the present invention.

Meanwhile, the gains obtained via such five feed-in antenna components 21, 22, 23, 24, 25 are all 25 dB±0.2 dB, the coverage range viewed from the disc is −30 to 30 degrees, and, for a high-gained antenna, this 60-degree coverage range indicates a comparatively excellent feature, thus becoming one of the mainstream items for current mobile communication technologies. Moreover, in addition to 38 GHz, the present invention further feeds electromagnetic wave energy of 37~39 GHz, e.g., 37.5 GHz illustrated in FIG. 8B and 38.5 GHz in FIG. 8C, and the acquired field views demonstrate similar effects and features, thus the descriptions thereof are omitted for brevity.

As such, due to the characteristics of vertical orthogonality, it can be understood that the coverage ranges created by the radiation beam of the five feed-in antenna components 21, 22, 23, 24, 25 may uniformly distribute to generate multiple communication service coverage areas, so, obviously, it is possible to effectively improve the coverage rate of the communication service applied at 37~39 GHz through the technology of the present invention.

In comparison with other prior art technologies, the method for achieving multiple beam radiation vertical orthogonal field coverage by means of multiple feed-in dish antenna according to the present invention provides the following advantages:

1. The present invention is capable of creating multiple mutually vertical orthogonal radiation fields and the generated energy radiation gains are consistent so as to increase the energy coverage rate of the required electro-magnetic wave radiation environment and improve transmission efficiency.

2. The antenna system of the present invention operates on the frequency bands of millimeter waves and generates multiple radiation beams, and such multiple radiation beams demonstrate the mutually vertical orthogonal effect and the antenna radiation gains between such multiple radiation beams are equal.

3. The present invention takes the aforementioned offset-focusing approach for implementation; briefly speaking, originally, the condition that the position of the feed-in antenna deviates from the focus may be referred as "defocusing", but this kind of defocusing has been further modified in the present invention such that, although the generated radiation beam may present reduced performance, this approach does facilitate significantly better energy coverage rate and enhanced transmission efficiency.

Although the present invention has been disclosed through the detailed descriptions of the aforementioned embodiments, such illustrations are by no means used to restrict the present invention. Skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A method for achieving multiple beam radiation vertical orthogonal field coverage by means of multiple feed-in dish antenna, comprising:

using a total metallic disc and plural feed-in antenna components capable of radiating electro-magnetic wave energy applicable for frequency bands of 37~39 GHz, initially analyzing the radiation waveform generated by one of the feed-in antenna components in order to acquire the highest gain and most suitable radiation beam width, and then making the highest gain and the most suitable radiation beam width correspond to the reflection face of the total metallic disc thereby obtaining the phase focusing center;

by means of offset-focusing, making the feed-in antenna component corresponding to the phase focusing center of the total metallic disc not achieve the perfect focusing, and allowing other feed-in antenna components to extend in an axial fashion such that the radiation beams emitted from other feed-in antenna components can also utilize the phase focusing center of the total metallic disc;

performing operations, finally, on the radiation beams generated by each of the feed-in antenna components thereby figuring out the coverage range and gain for each radiation beam, so that the coverage of multiple radiation beams can evenly distribute to create multiple vertical orthogonal radiation fields in order to use such multiple vertical orthogonal radiation fields to change the structure of the reflection face of the total metallic disc, thus achieving the objective of multiple beam radiation vertical orthogonal field coverage.

2. The method for achieving multiple beam radiation vertical orthogonal field coverage by means of multiple feed-in dish antenna according to claim 1, wherein the structure of the reflection face on the total metallic disc can be adjusted such that each radiation beam can exhibit features of equivalent gain, vertical orthogonality and low lateral radiation beams.

3. The method for achieving multiple beam radiation vertical orthogonal field coverage by means of multiple feed-in dish antenna according to claim 1, wherein analyzing the radiation waveform generated by one of the feed-in antenna components is to first analyze and design the shape of the radial face on the reflection face by using the radiation waveform generated by one of the feed-in antenna components, and the shape equation for each point coordinate of the radial face on the reflection face is shown as below:

$$x(t,\varphi)=a\cdot t\cos\varphi\cdot r(\varphi)xo$$

$$y(t,\varphi)=b\cdot t\cos\varphi\cdot r(\varphi)+yo$$

wherein (x(t,φ)y(t,φ)) indicates the projection coordinates of the reflection face on the x-y plane, (xo,yo) the projection center of the disc face thereof, and (t,φ) represents parameters in the radial direction and angular direction of the polar coordinate system on the x-y plane, in which the range of t is defined as $0\le t\le 1$, the range of ψ is $0\le\varphi\le 2\pi$, so that a and b respectively means the radius of the reflection boundary projected on the x axis and the y axis of the x-y coordinate plane, while the equation of r(φ) is shown as below:

$$r(\phi)=\frac{1}{(|\cos\phi|^{2v}+|\sin\phi|^{2v})^{1/2v}}$$

wherein the value oft indicates the boundary shape of the radial face, and the value of v can be used to control the boundary shape.

4. The method for achieving multiple beam radiation vertical orthogonal field coverage by means of multiple feed-in dish antenna according to claim 3, wherein it is possible to analyze and design the shape of the reflection face, and the shape equation for the reflection face is shown as below:

$$z(t,\varphi)=\Sigma_{n=0}^{N}\Sigma_{m=0}^{M}(C_{nm}\cos n\varphi+D_{nm}\sin n\varphi)F_m^n(t)$$

wherein z(t,φ) indicates the coordinate on the z axis, N and M the terms of the applied basis functions, and n and m represent the indices thereof to correspond to the applied basis functions, in which and $C_{nm}$ and $D_{nm}$ are the coefficients of the series expansions, while $F_m^n(t)$ means the modified Jacobi polynomial, so that it is possible to calculate $C_{nm}$ and $D_{nm}$ through integral equations and derive the highest gain and the most suitable radiation beam width by way of $C_{nm}$ and $D_{nm}$, and make the obtained highest gain and most suitable radiation beam width correspond to the reflection face of the total metallic disc thereby acquiring the phase focusing center.

5. The method for achieving multiple beam radiation vertical orthogonal field coverage by means of multiple feed-in dish antenna according to claim 4, wherein, by means of offset-focusing, the feed-in antenna component corresponding to the phase focusing center of the total metallic disc does not achieve the perfect focusing, but it is required to use an iteration procedure to adjust $C_{nm}$ and $D_{nm}$ so as to find out the coverage range and gain of each radiation beam, and the coverage of multiple radiation beams can uniformly distribute there between so as to generate the radiation field thus changing the structure of the reflection face on the total metallic disc with the radiation field.

6. The method for achieving multiple beam radiation vertical orthogonal field coverage by means of multiple feed-in dish antenna according to claim 1, wherein other feed-in antenna components may extend in a horizontally axial or vertically axial fashion.

7. The method for achieving multiple beam radiation vertical orthogonal field coverage by means of multiple feed-in dish antenna according to claim 1, wherein the created multiple radiation fields must be mutually vertical orthogonal, and the method for achieving such a vertical orthogonality comprises:

(1) defining the relative positions of the feed-in antenna components and the total metallic disc;

(2) adjusting the curvature of the total metallic disc such that the focusing point transforms from a point to an axis, and the gain and the beam width of each of the feed-in antenna components through the radiation field of the total metallic disc become consistent;

(3) adjusting further the intervals between each of the feed-in antenna components such that the highest point of the energy in the radiation field of one feed-in antenna component is located at the zero-point position of the radiation field of another feed-in antenna component, thus achieving the objective of multiple beams and radiation field vertical orthogonality.

8. The method for achieving multiple beam radiation vertical orthogonal field coverage by means of multiple feed-in dish antenna according to claim 1, wherein the feed-in antenna component may be an output component capable of radiating electro-magnetic wave energy applicable for the required frequency bands, and the required frequency bands may range 37~39 GHz.

9. The method for achieving multiple beam radiation vertical orthogonal field coverage by means of multiple feed-in dish antenna according to claim 1, wherein the feed-in antenna component is a lens-typed horn antenna and includes a metallic waveguide, and the opening at the top end of the waveguide has a dielectric structure including a top edge and a bottom edge, in which the bottom edge of the dielectric structure is connected to the opening at the top end of the waveguide, and the bottom edge of the dielectric structure has a curve toward the top edge.

10. The method for achieving multiple beam radiation vertical orthogonal field coverage by means of multiple feed-in dish antenna according to claim 9, wherein the dielectric structure is made of materials enabling electro-magnetic wave penetration, effect of low losses as well as phase variation effect of electro-magnetic wave radiation field.

11. The method for achieving multiple beam radiation vertical orthogonal field coverage by means of multiple feed-in dish antenna according to claim 9, wherein the dielectric feature in the dielectric structure of the feed-in antenna component allows the gains, the radiation beam widths and polarization differences obtained by all the feed-in antenna components to be very close.

12. The method for achieving multiple beam radiation vertical orthogonal field coverage by means of multiple feed-in dish antenna according to claim 1, wherein the energy radiation gain that each feed-in antenna component can generate must be equivalent.

* * * * *